US009593507B1

(12) United States Patent
Aicher, Jr.

(10) Patent No.: US 9,593,507 B1
(45) Date of Patent: Mar. 14, 2017

(54) FREESTANDING ADJUSTABLE TENT

(71) Applicant: Daniel Gerard Aicher, Jr., Anchorage, AK (US)

(72) Inventor: Daniel Gerard Aicher, Jr., Anchorage, AK (US)

( * ) Notice: Subject to any disclaimer, the term of this patent is extended or adjusted under 35 U.S.C. 154(b) by 0 days.

(21) Appl. No.: 14/922,460

(22) Filed: Oct. 26, 2015

(51) Int. Cl.
*E04H 15/58* (2006.01)
*E04H 15/00* (2006.01)
*E04H 15/40* (2006.01)
*E04H 15/36* (2006.01)

(52) U.S. Cl.
CPC ..... *E04H 15/003* (2013.01); *E04H 15/36* (2013.01); *E04H 15/40* (2013.01)

(58) Field of Classification Search
CPC ..... E04H 15/40; E04H 15/003; E04H 15/36
USPC ..... 135/125, 117
See application file for complete search history.

(56) References Cited

U.S. PATENT DOCUMENTS 3,394,720 A * 7/1968 Moss ..... E04H 15/003 135/118
5,299,590 A * 4/1994 Deibert ..... E04H 15/58 135/125
5,950,649 A * 9/1999 Gerig ..... E04B 1/32 135/124
6,192,909 B1 2/2001 Strausser
6,827,094 B1 * 12/2004 Bramwells ..... E04H 15/58 135/115
7,201,177 B2 4/2007 Anticoli
7,316,239 B2 * 1/2008 Yang ..... E04H 15/003 135/117
7,607,445 B2 * 10/2009 von Dewitz ..... E04H 15/425 135/114
7,673,642 B1 * 3/2010 Shires ..... E04H 15/36 135/119
7,789,097 B1 * 9/2010 Sotirkys ..... E04H 15/06 135/88.01
8,001,986 B2 * 8/2011 Shumate ..... E04H 15/62 135/116
8,087,423 B2 * 1/2012 Knipschild ..... E04H 15/003 135/116
8,342,197 B2 * 1/2013 Roman ..... E04H 15/001 135/125

(Continued)

FOREIGN PATENT DOCUMENTS

WO WO 2015009738 A1 * 1/2015 ..... E04H 15/38

*Primary Examiner* — Noah Chandler Hawk

(57) ABSTRACT

An easily deployable freestanding tent for individuals of all ages that is adjustable to accommodate use on varying terrain gradients. At least two collapsible arc-shaped frame members being connected support the tent, the frame assembly being connected with at least two movably securable devices that allow a user to adjust the apex of said frame members to provide a vertically upright configuration on sloping terrain. The frame assembly being constructed of lightweight high-strength materials and intended for use in recreation, commercial, and emergency use applications. Beneficially, users deploy this embodiment first by connecting the pole sections to form the frame members, then securing the top of said frame's apex by manipulating an intersection knot to a vertical configuration effectively setting the adjustable frame upright on even or uneven terrain, and further tensioning a main cord and adjusting a fabric cover as necessary to provide a durable substantially enclosed shelter.

13 Claims, 7 Drawing Sheets

(56) References Cited

U.S. PATENT DOCUMENTS

| | | | | |
|---|---|---|---|---|
| 8,757,185 | B1 * | 6/2014 | Muzzio | B63B 17/02<br>114/361 |
| 2002/0134415 | A1 * | 9/2002 | Boulange | E04H 15/18<br>135/117 |
| 2016/0053508 | A1 * | 2/2016 | Gutwenger | E04H 15/40<br>135/143 |

* cited by examiner

FREESTANDING ADJUSTABLE TENT

CROSS-REFERENCE TO RELATED APPLICATIONS

This application claims the benefit of provisional patent application Ser. No. 62/068,211, filed 2014 Oct. 24 by the present inventor.

TECHNICAL FIELD OF THE INVENTION

This invention relates generally to the temporary shelter, outdoor recreation and hunting and camping arts, and more specifically to a collapsible all-terrain shelter for use in arctic, mountainous and forested environments.

BACKGROUND

Tents and shelters used for outdoor recreation are generally classified into two categories: freestanding (FS) and non-freestanding (NFS). FS tents are typically heavier and can stand erect on their own without any other structural support. NFS tents are typically lighter and cannot stand erect on their own without a supporting means; these tents are held upright by some form of supporting means in combination with being staked down on multiple opposing sides.

Generally speaking, individuals recreating in the backcountry tend to prefer lighter weight tents because they must carry the tent along with other gear to a distant location. In most cases the lightest tents are of the NFS design which does not require a freestanding frame, with many of these NFS tents weighing less than three pounds. The tradeoff for having a lightweight NFS tent is the constant challenge of finding a suitable tent site and then creatively setting up and securing the tent to whatever means are available.

One main disadvantage for many NFS tents is the requirement for trees or other vertical features to support the tent's ridgeline; in arctic or tundra environments this type of NFS tent would likely be unusable. Many times while recreating afield when an individual discovers a desirable location to stop and photograph, camp or hunt, or when adverse weather develops quickly, natural cover or suitable, flat and even terrain is not in the immediate area.

If minimal weight is not a priority, FS tents are preferable as they are more stable and typically provide more coverage. Although most FS tents have the inherent disadvantage of requiring at least four pole endpoints to contact the ground in order to support the tents structure. This characteristic of FS tents requires a flat and even graded tent site for the FS tent to properly stand vertically upright. Without a flat tent site, FS tents will lean at an angle which decreases the amount of horizontal overhead coverage provided by the tent thus allowing more precipitation into the sheltered area.

However some FS tents, such as the U.S. Pat. No. 6,192,909 to Strausser, are capable of adjusting to uneven terrain, although the bulk and weight of this shelter when collapsed would likely be considered too heavy for many users. Other FS tents such as the Application Number PCT/US2014/046722, provide adjustable weatherproof protection, but this tent design necessitates the use of heavier frame members and hardware which requires assembly in the field.

There are a number of prior art shelters which attempt to overcome the above identified disadvantages. However, such devices only address one of the problems. For example, the shelter may be adjustable, but it is still relatively heavy; another may be lightweight but it is still relatively difficult to set up; yet others include additional features which are not necessarily required by the user, such as vestibules and integrated cot assemblies, these additional features adding to the weight and cost of the shelter.

There thus remains a need for a relatively inexpensive basic lightweight freestanding and adjustable shelter which, in general, is the object of the present invention. Such an inventive assembly would be capable of being quickly and easily pitched in mountainous and tundra and forested environments, will be freestanding and have the ability to adjust and stand upright on sloping or uneven terrain, will be strong enough to protect occupants against weather typically encountered in the backcountry, and will be collapsible and compact so it can be easily carried in a backpack.

SUMMARY

The following presents a simplified summary of some embodiments in order to provide a basic understanding of my invention. This summary is not all-inclusive in that it does not include all aspects or infer critical elements or delineate the scope of the invention. Its sole purpose is to present some embodiments and one or more aspects thereof as a prelude to a more detailed description that is presented later.

In the present invention, an adjustable tent having at least two generally are shaped collapsible supporting frame members providing a shelter which is durable and highly efficient in use. In an embodiment, the frame members are oriented perpendicularly and connected at a common vertical axis by a movably securable fastening means, whereby manipulation of said fastening means being a mode of adjusting and symmetrizing the tent frame's configuration.

In one aspect of this embodiment, a movably securable fastening means comprised of an adjustably securable device or intersection knot connecting said pole frame members at one or more intersecting points. In this embodiment, a cord loop is wrapped and tied around an intersecting point of said frame members providing a self-tightening means of limiting relational rotation of said poles to a predetermined angle; an aspect of this embodiment limiting relational rotation of said poles to approximately 90 degrees thereof.

In this embodiment, a secondary movably securable device or main cord means being fastened to a longitudinal pole frame member at the front end and rear end of said frame member, said main cord means being further wrapped circumferentially around a latitudinal pole frame member that is perpendicularly oriented and connected to said longitudinal frame member.

In an aspect of this embodiment, location of the main cord means can be manipulated upward and downward along said latitudinal frame member's axial direction to increase or decrease tension on the main cord, wherein tensioning said main cord thus pulls the front end and rear end of said longitudinal frame member downward configuring the adjustable tent frame. In one aspect of this embodiment, movement of the main cord further increases or decreases tension on the tent frame assembly providing a method of configuring the adjustable tent for setup or takedown.

In a preferred embodiment, a fabric cover being connected to one or more frame members and fastened to portions of said main cord means is provided. An aspect of this embodiment includes portions of the collapsible fabric cover being sewn around the cord providing a conduit for the cord to run through, in this embodiment the main cord when configured stretches portions of said fabric taut while also connecting the tent's pole frame assembly. When erect, the fabric cover is pulled taut across the tensioned and adjusted tent frame being adjustably secured to two or more corner points of said frame.

For a more complete understanding of the nature and advantages of the present invention, reference should be made to the ensuing detailed description and accompanying drawings.

Figure 1:
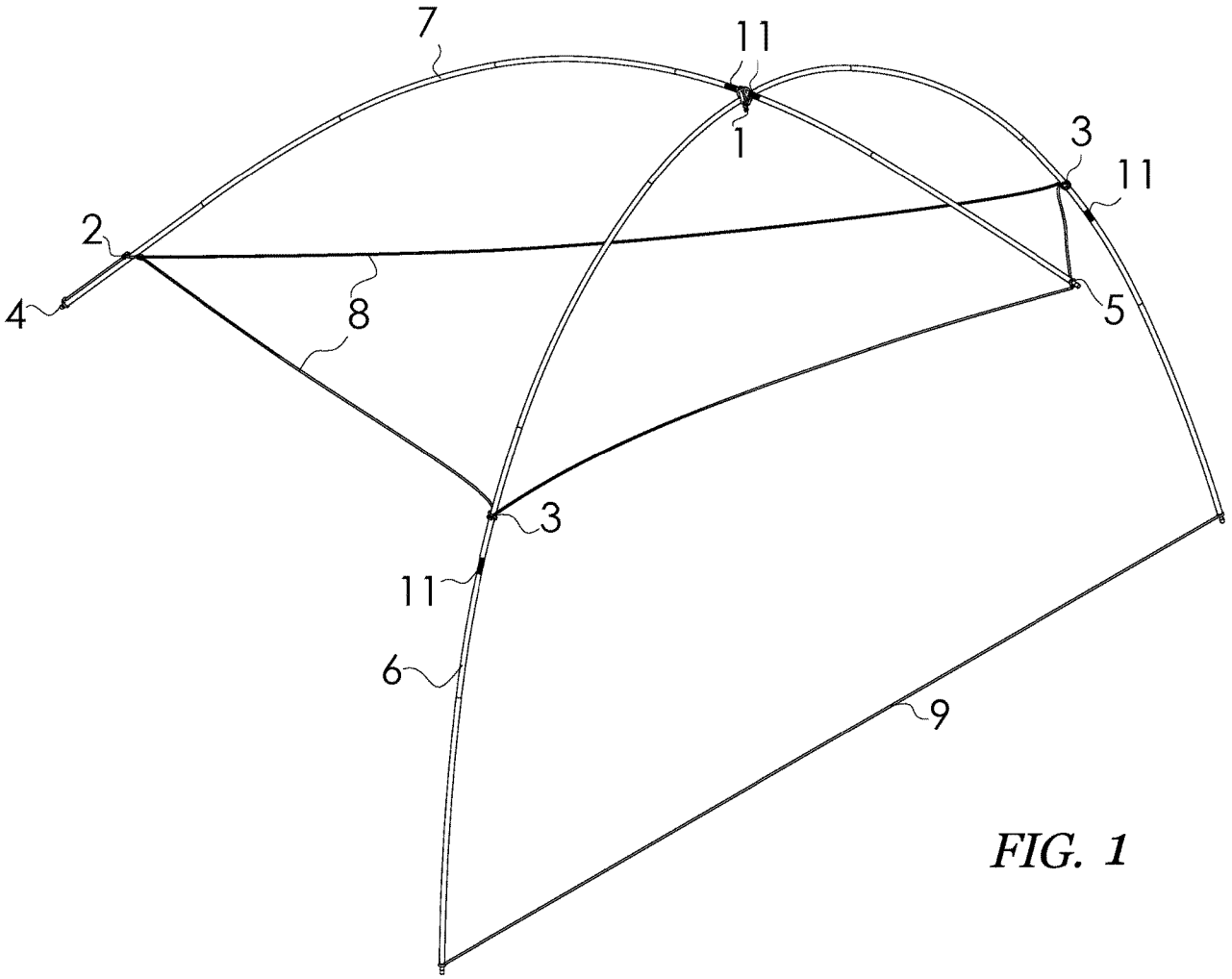
FIG. 1 shows a perspective view of this embodiment in an erect configuration with fabric canopy removed to show various aspects of the tent frame assembly.

| Reference Numerals | | | |
|---|---|---|---|
| 1 | Intersection knot | 2 | Rear Tie-In |
| 3 | Main Cord Wraps | 4 | Tip End Loop |
| 5 | Tip Front Loop | 6 | Arch Pole |
| 7 | Spline Pole | 8 | Main Cord |
| 9 | Ground Cord | 10 | Fabric Cover |
| 11 | Visual Markers | 12 | Symmetry Knots |

DETAILED DESCRIPTION OF SPECIFIC EMBODIMENTS

Figure 2:
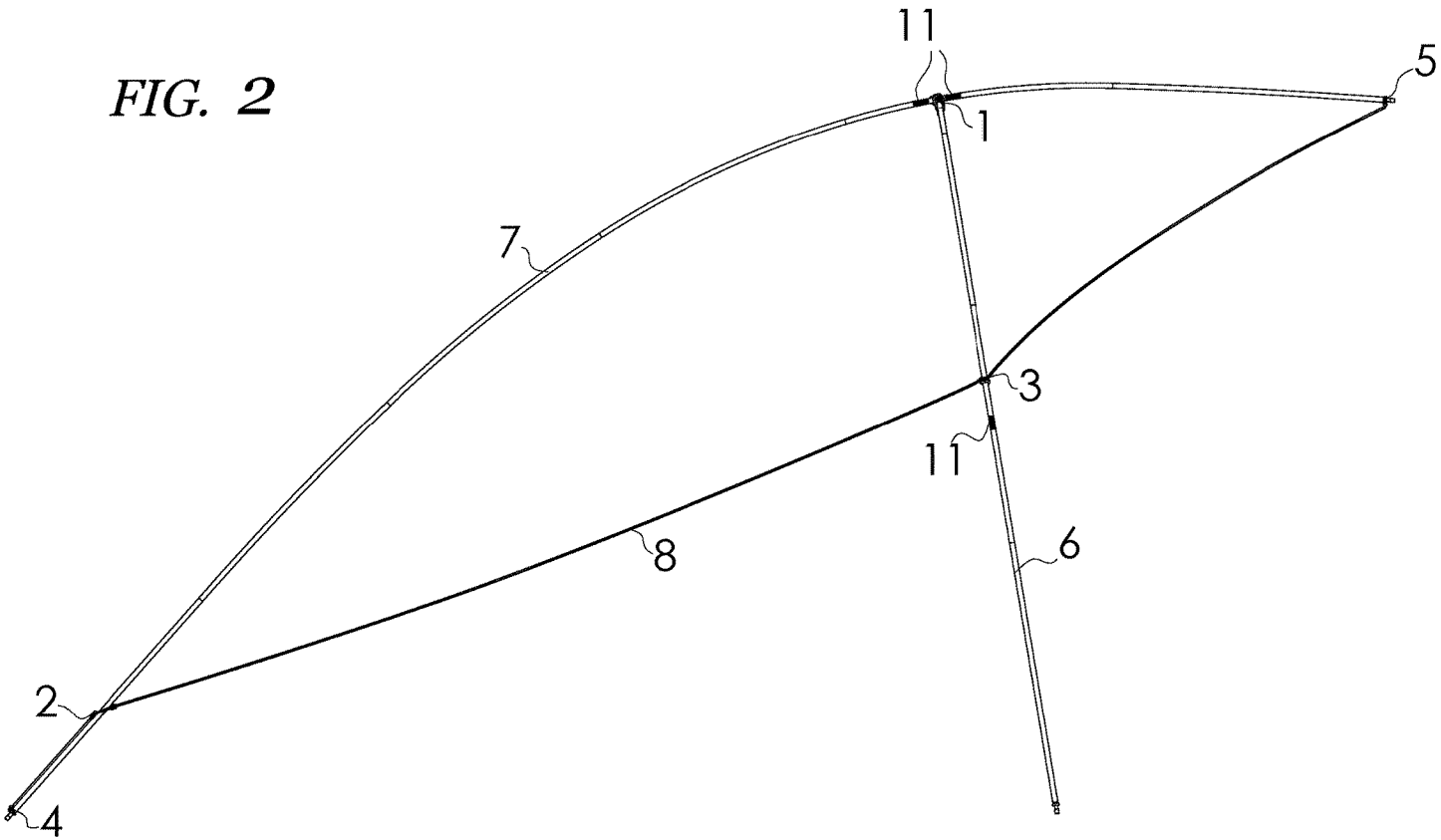
FIG. 2 is an elevation view showing aspects of one embodiment.
Figure 3:
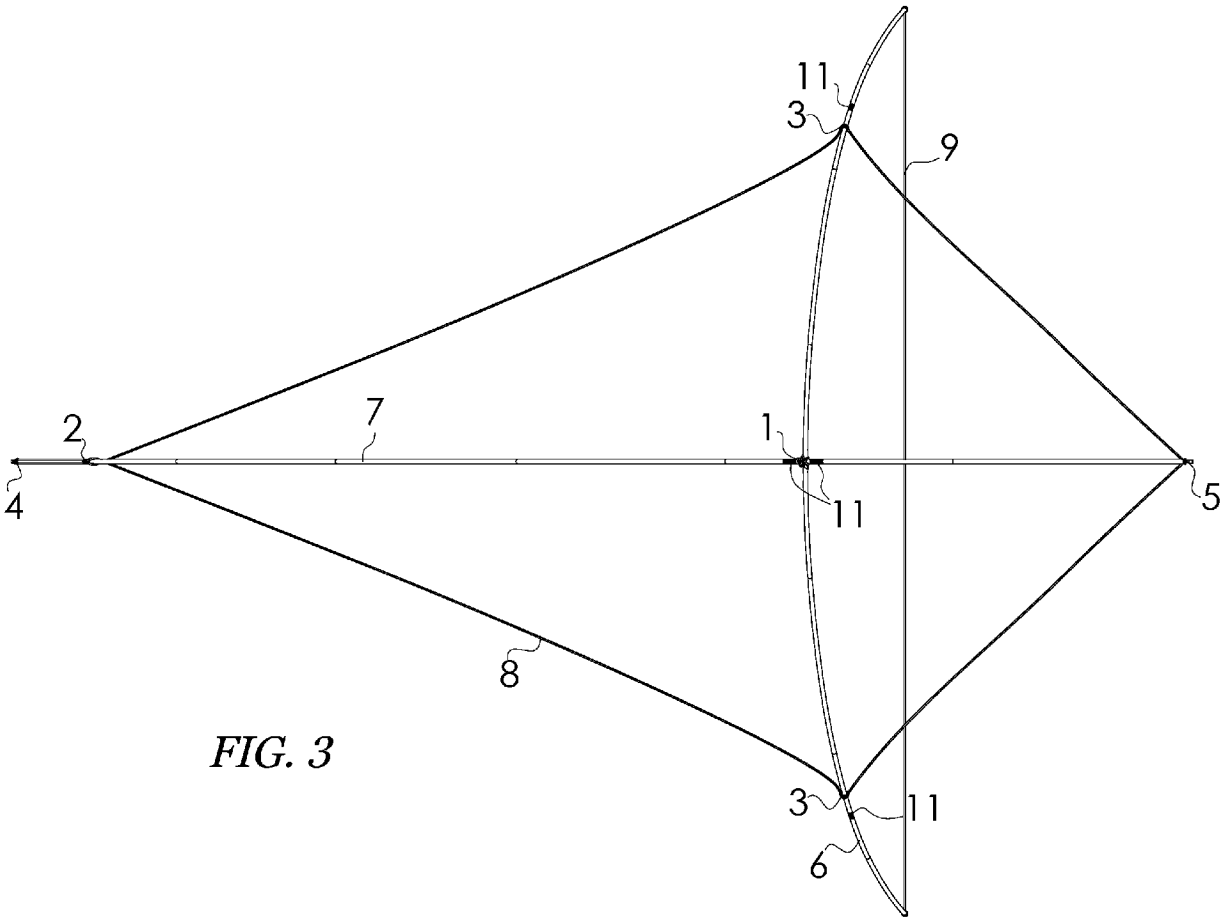
FIG. 3 is a plan view showing a symmetrically configured embodiment.

FIGS. 1-3, and 5 are perspective views of this embodiment with the fabric cover removed for clarity. FIG. 1 represents this embodiment from an isometric perspective with various aspects being referenced and defined herein. FIG. 2 is an elevation view of this embodiment further illustrating the tent frame's structure. In closely examining this embodiment as shown in FIGS. 1 and 2, an elegant and simplistic freestanding frame is provided wherein an arc-shaped spline pole 7 forming a longitudinally oriented ridge frame member is supporting and being supported by an arch-shaped pole 6 frame member.

In an embodiment shown in FIG. 1, an adjustable tent frame comprising a structural arch pole 6 frame member being restrained by a ground cord 9 or strap means in a predetermined arch configuration, a spline pole 7 frame member supporting and being supported by said arch pole 6 frame member, a first movably securable device or intersection knot 1 connecting said frame members at an intersecting point thereof, and a second movably securable device or main cord 8 further connecting said frame members.

In the adjustable frame of FIG. 1, frame members 6 and 7 are comprised of a plurality of shorter tube sections that are connectable in series providing collapsible and compact poles, said collapsible poles enabling a user to easily break down the frame assembly for transporting and storing this embodiment. Frame members 6 and 7, when erect are generally perpendicular in orientation, being connected by a self-securing intersection knot 1.

The intersection knot 1 being comprised of a loop made of cord in essence having said cord's endpoints fastened together at said intersection knot 1 leaving a cord loop as represented by an elongated double cord structure. In one aspect, the intersection knot 1 is wrapped and secured around an intersecting point of said frame members, wherein the intersection knot 1 or similar device is intended to allow movability of said frame members while securely fastening the frame assembly together. In the embodiment shown in FIG. 1, a preferred location of said intersection knot 1 being the point where said spline pole 7 intersects the approximate apex of said arch pole 6, further having said arch pole 6 intersecting said spline pole 7 at a point approximately one-third to one-half the length of said spline pole 7 as measured from an end thereof.

Figure 6:
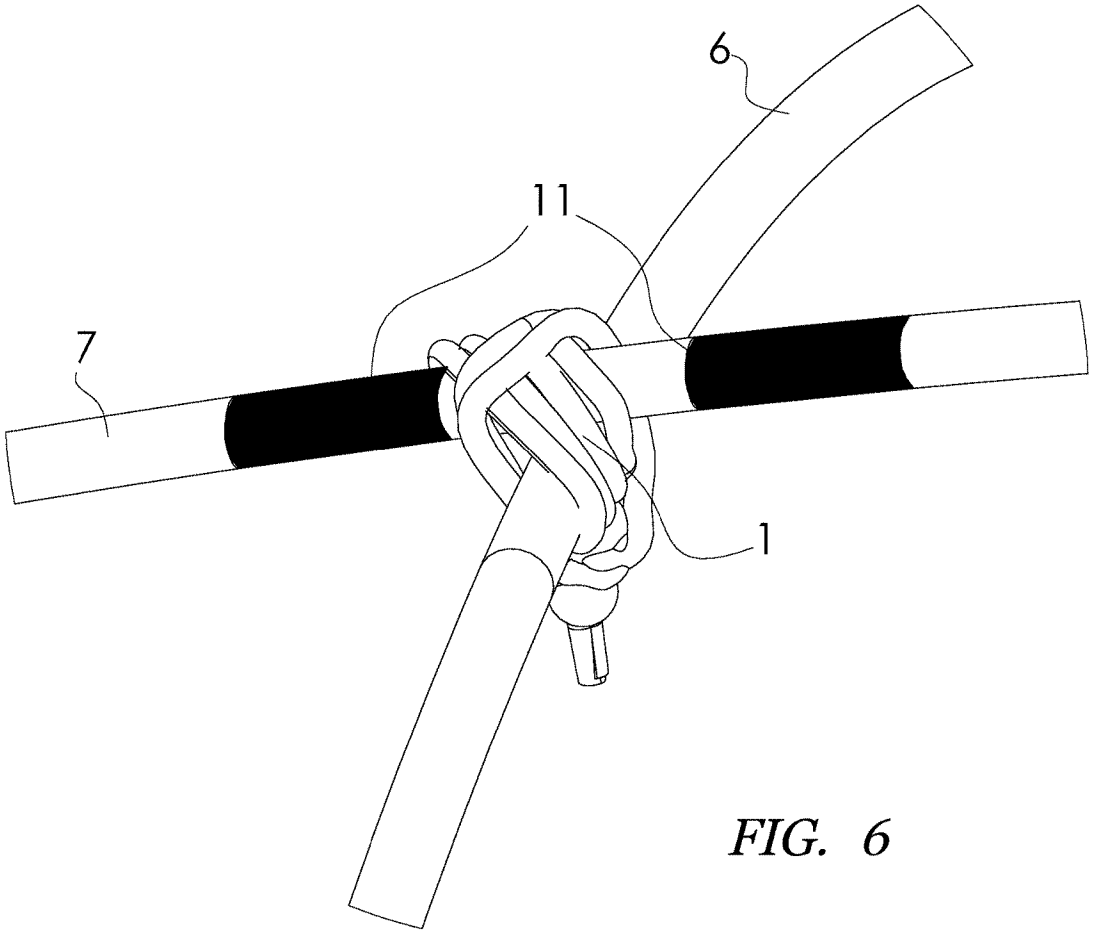
FIG. 6 is an enlarged view of the intersection knot in accordance with one embodiment.

The intersection knot 1 of FIG. 6, comprising a double cord being wrapped and secured around an intersecting point of said frame members when said frame members 6 and 7 are held in a parallel and contiguous configuration, as said frame members 6 and 7 rotate in relation to one another said intersection knot is tensioned thus tightening its grip on the frame assembly. As shown in FIG. 6, said intersection knot 1 having a predetermined length to reach optimal grip as the poles are moved to an approximate 90 degree angle or an angle more or less than 90 degrees in relation to each other. In a second aspect, said intersection 1 knot further including a secondary knot fastening a cord wrapped around the intersection of said pole assembly in a fashion that restrains relational rotation of said poles such that said poles are not rotated beyond predetermined angles in an undesirable direction.

The location of said intersection knot 1 is set to optimally balance this embodiment and proportionally distribute vertical and horizontal loads imposed on the adjustable tent. It shall be noted that multiple movably securable devices similar to the intersection knot 1 could be used if three or more pole members are used in the frame assembly. One embodiment includes developing an adjustable frame assembly comprised of three or more frame members designed with the intent of providing additional weatherproofing coverage; however this embodiment is not defined herein or illustrated in a figure.

The adjustable tent frame assembly shown in FIG. 1, comprising a movably securable device or main cord 8 being an elongated loop made of cord in essence having said cord's endpoints fastened together by a tip end loop 4 being located on the rear end of spline pole 7, and further fastened at the midpoint of said main cord by the tip front loop 5 being located on the front end of said spline pole 7. In this embodiment said main cord 8 is doubled in structure. An aspect of this embodiment enabling each individual cord within said main cord 8 to act independently on opposing sides of the frame assembly, while being connected and supportive of the frame assembly in its entirety.

As shown in FIGS. 1, 2, 3, and 5, the main cord 8 connects the frame assembly being securely fastened to each frame member. In one embodiment, said main cord 8 connects to the spline pole 7 frame member at the front end tip and rear end tip of said frame member, in between said end tips said main cord 8 being further wrapped circumferentially around the arch pole 6 frame member that is perpendicularly oriented and connected to said spline pole 7. One aspect of this embodiment comprises a tip end loop 4 and a tip front loop 5 being tied at each end of the main cord 8, further being connected to each respective end of said spline pole 7.

As shown in FIG. 2, between the tip end loop 4 and the tip front loop 5 being at each end of the spline pole 7, said main cord 8 being wrapped circumferentially around the arch pole 6 frame member forming the main cord wraps 3. At the upper-front end of this embodiment the main cord 8 connects to the spline pole 7 via the tip front loop 5, or similar fastening means. At the rear-bottom end of this embodiment the main cord 8 connects to the spline pole 7 at the rear tie-in 2 point. The main cord 8 continuing rearward after connecting to the spline pole 7 via the rear tie-in 2 being securely fastened to the rear-bottom end of the spline pole 7 by the tip end loop 4 or other fastening means. The rear tie-in 8 is comprised of two knots with two cords in between containing the rear tie-in 8 around the spline pole 7, further providing said rear tie-in 2 to be movably connected to the spline pole 7 enabling said rear tie-in 2 to easily move to facilitate setup and takedown of this embodiment.

The main cord 8 as shown configured under tension in FIGS. 1, 2, 3, and 5, wherein said main cord 8 being fastened to the front end and rear end of spline pole 7, in between these fastened points having main cord wraps 3 being the lineal portion of said main cord 8 that circumferentially wraparound said arch pole one or more revolutions, from the main cord wraps 3 said main cord 8 continues in opposing directions to the tip end loop 4 and tip front loop 5, each of said loops being a connecting means to the spline pole 7. In an aspect of this embodiment, the main cord 8 is made of 550 lb. paracord, though many types of dynamic or static cordage or strapping would likely work as a suitable replacement. In a second aspect of this embodiment, the main cord 8 being comprised of a material with abrasive qualities when held adjacent to metal, fiberglass or carbon fiber materials commonly used for frame members 6 and 7.

The embodiment as shown in FIGS. 1 and 2, comprising at least two frame members of equal or unequal length poles. In this embodiment the arch pole 6 frame member is approximately 154" in length and the spline pole 7 frame member is approximately 137" in length; although, a similar adjustable frame could be made with a combination of unequal length poles, or equal length poles to support, for example, a fully enclosed fabric cover.

The intersecting point of said frame members 6 and 7 having a location approximately one third the distance of the spline pole 7 as measured from the front end of said spline pole 7 is used as a preferred intersection point, wherein the two frame members 6 and 7 intersect being fastened together at said intersection point. Conceivably, another configuration of this embodiment could include fastening the intersecting point of the frame members at their respective midpoints, which if frame members 6 and 7 were made of equal length poles this embodiment would produce a dome shaped structure to the shelter with four pole ends in contact with a ground surface; however this configuration was not included in the drawings or described herein. Thus, a reader can see that moving the intersecting point of the frame members will change the shape of this embodiment while still being within the general nature of the invention.

Figure 4:
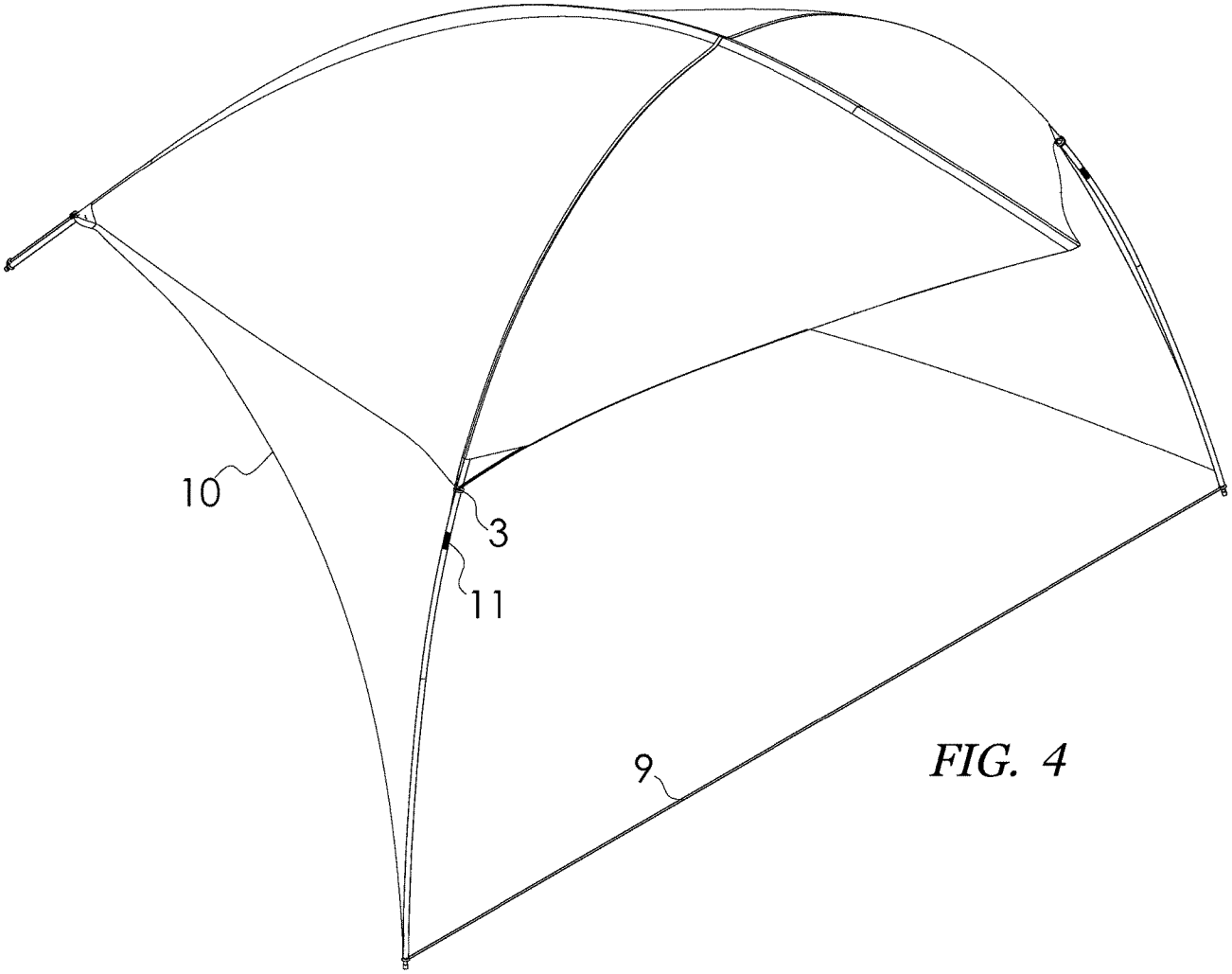
FIG. 4 illustrates an aspect of this embodiment including a fabric cover.
Figure 7:
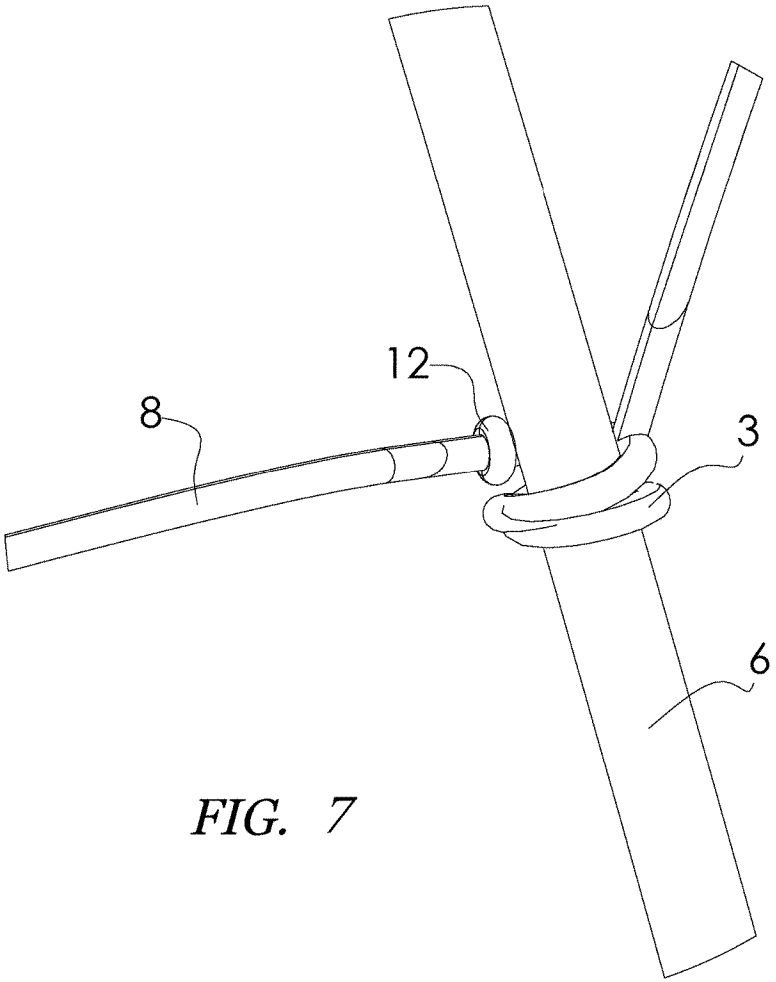
FIG. 7 is an enlarged view of the main cord wraps in accordance with one embodiment.

FIGS. 1-5 illustrate this embodiment in an, erect configuration. FIGS. 6 and 7 represent aspects of the intersection knot 1 and main cord wraps 3 respectively. This embodiment, as represented by the drawing figures showing aspects thereof, is made of collapsible materials to enable a user to more easily transport and utilize the adjustable tent. The adjustable frame assembly of FIG. 4 represents a completely integrated shelter system wherein each aspect of this embodiment is connected and supportive of each adjacent component.

Operation—FIGS. 1-7

The manner of using the adjustable tent to provide a weatherproofing shelter is similar to that for tents and shelters in present use. However, it shall be noted that this embodiment, as defined herein, is a fully integrated system. This embodiment does not require assembly when deployed as there are no discrete components; rather, when put to use the adjustable tent is simply unrolled with the pole sections being connected, adjusted and tensioned providing a rigid freestanding shelter.

In an embodiment, said adjustable tent providing a substantially enclosed shelter with an adequately sized cantilevered opening being covered negating the need for a door, allowing an open view out of the front thereof, providing an interior peak height of approximately 56 inches above ground supplying ample weatherproof coverage for one or more occupants and their belongings. This embodiment is intended to provide a dual purpose shelter primarily supplying weatherproof coverage for protection against rain, snow and wind, said shelter also being used to effectively conceal occupants for the purposes of hunting, photography, etc.

This embodiment provides a solution for users who prefer to stay outdoors for extended periods of time, supplying adaptable and stable shelter in nearly any terrain environment. Being constructed of lightweight high-strength materials this embodiment is intended for use in recreation as well as emergency use applications. In one embodiment, having carbon fiber frame members and 30d silnylon fabric cover the adjustable tent delivers ample shelter for two while weighing approximately 1.5 pounds.

A relatively quick process for deploying this embodiment includes setting up the frame assembly, adjusting said frame to provide a vertically upright configuration on flat, sloping or uneven surfaces, tensioning the main cord and further tightening the fabric cover. The following narrative may act as a guide to a preferred mode of operation, although alternative modes of operating this embodiment are conceivably included within the general spirit of the invention. Wherein, a freestanding adjustable tent, comprising:

A collapsible pole frame assembly being fastened together at one or more intersecting points with a movably securable device, in an embodiment said movably securable device being an intersection knot 1, said intersection knot 1 providing a means of connecting and configuring said pole frame assembly. Said pole frame assembly having at least two frame members, an aspect of this embodiment having an arch pole 6 being bowed and held in an arch shape by a ground cord 9 or other fastening means, said frame further including a spline pole 7 that is supporting and being supported by said arch pole 6 being connected to said arch pole 6 with the intersection knot 1 and main cord 8.

Each frame member, being collapsible in nature, is first connected together providing at least two structural poles 6 and 7. After all pole sections are put together the arch pole 6 is connected on both ends by said ground cord 9 which holds the arch pole 6 in an arch shape. Although not shown in the drawing figures, when said main cord 8 is slackened and thus not under tension the spline pole 6 is approximately straight and resting on top of the arch pole 6 in a perpendicular orientation. Next, the intersecting point of said poles 6 and 7 is moved to a predetermined or desirable location by adjusting said poles, and thus the intersection knot 1, vertically center over a preferred site on the ground, said poles 6 and 7 further being rotated relationally to an approximate 90 degree position thereof which acts to tighten said intersection knot 1.

The intersection knot 1 of FIG. 6, being a cord loop is wrapped and tied around an intersecting point of said frame members 6 and 7 forming the intersection knot 1. As said frame members 6 and 7 are rotated the intersection knot 1 tightens due to being stretched and thus put under tension increasingly gripping and tightening the poles together as the poles are moved further to a perpendicular position. Whereby said intersection knot 1, when tensioned by rotating said frame members and thus stretching said intersection knot 1 thus tightening its grip on said poles, is intended to securely fasten the frame assembly providing a self-tightening means of limiting relational rotation of said poles to a predetermined angle.

Figure 5:
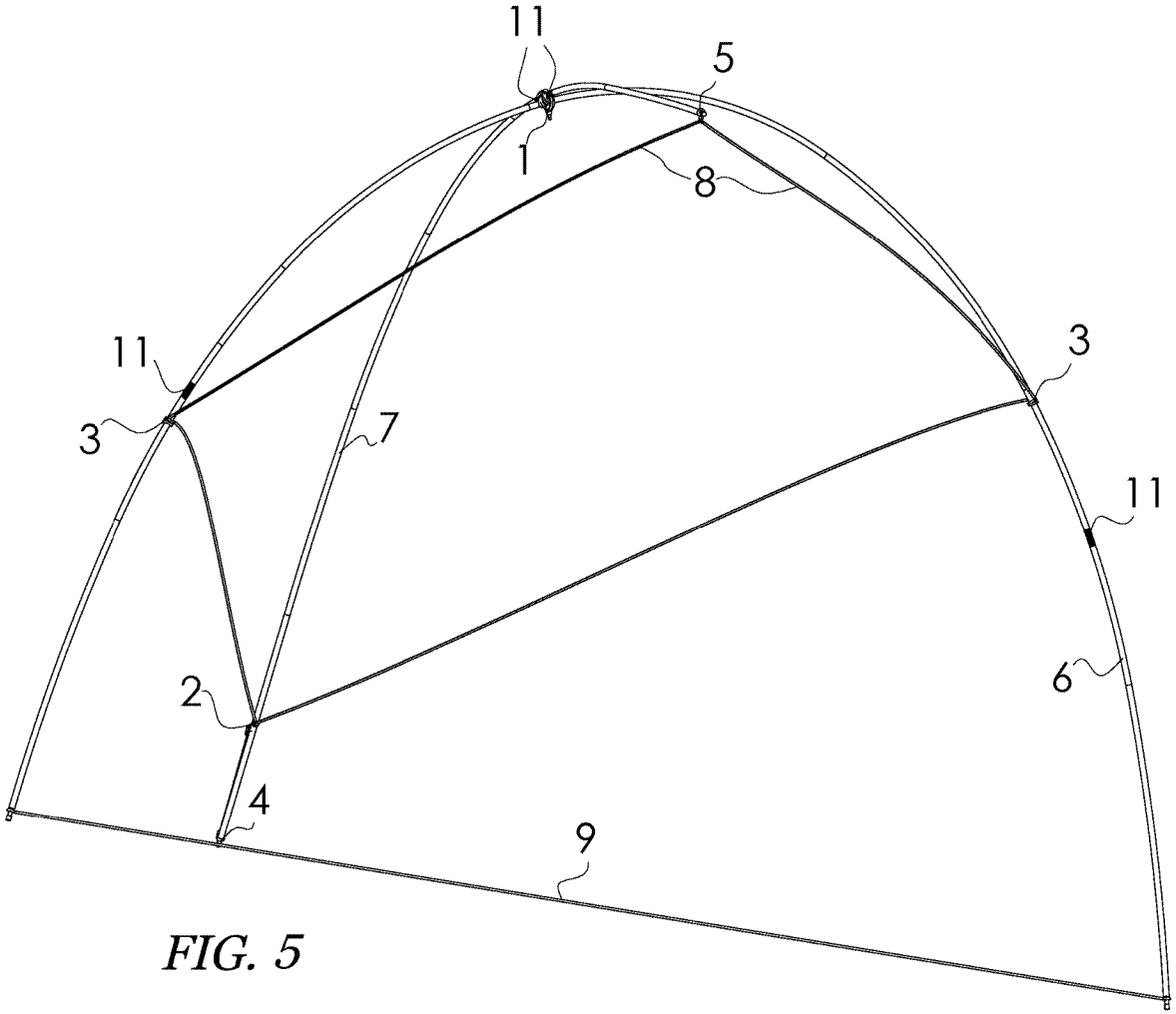
FIG. 5 represents this embodiment in a vertically upright asymmetrical configuration while on a sloping surface.

In aspects of this embodiment shown in FIGS. 1 and 5, adjusting the intersecting point of frame members 6 and 7, and thus the location of the intersection knot 1, to a point in space vertically above the base of said frame configures this embodiment in an upright erected position. In an embodiment shown in FIG. 1, when the frame is setup on a relatively flat planar surface the spline pole 7 will intersect the arch pole 6 at the approximate apex of said arch pole 6 providing a symmetrically configured frame assembly. In a second embodiment as shown in FIG. 5, when the frame is setup on a sloping or unevenly graded surface the spline pole 7 will intersect the arch pole 6 on one side of the approximate apex of said arch pole 6 providing an asymmetrically configured frame assembly.

Beneficially, in whatever type of terrain a user may find themselves in when adverse weather develops, they would simply deploy this embodiment first by connecting the poles sections forming pole frame members 6 and 7, then adjusting the top of said frame's approximate apex via manipulating the intersection knot 1 to a vertically desirable configuration, effectively setting the shelter upright and readying the fabric cover 10 for final tensional adjustments.

As shown in FIGS. 1-3, 5 and 6, the intersecting point of said frame members being the location of the intersection knot 1 having a somewhat fixed point on one or more of the poles. An aspect of this embodiment illustrated in FIG. 3, a fixed point along the spline pole 7 is always in contact with the arch pole 6. Advantageously, a second aspect as shown in FIG. 5 illustrates how the spline pole 7 is capable of tangentially sliding along the surface of the arch pole 6 in a direction perpendicular to said spline pole 7 while being connected to said arch pole 6, said poles 6 and 7 being movably secured by the intersection knot 1 or similar fastening means. Conveniently, visual markers 11 are placed on one or more of said frame members in predetermined locations to easily guide a user to setup this embodiment in a symmetrical configuration.

Visual markers 11 being placed on pole frame members 6 and 7 signify a predetermined location that can be used for one or more aspects of this embodiment. Visual markers 11 placed on the spline pole 7, being the longitudinal ridge frame member, at predetermined locations thereof providing an aid for adjusting the intersection of said frame members 6 and 7 and thus the intersection knot 1. In this embodiment as shown best in FIGS. 1-3 and 6, visual markers 11 on the spline pole 7 facilitate proper configurational adjustment of the intersection knot 1 so as to enable the frame to be freestanding, wherein the intersection of said frame members is adjusted in a way to provide a frame that stands vertically upright on the pole ends being self-supporting when erect.

A main cord 8 assembly comprising a main cord 8, main cord wraps 3, and symmetry knots 12 as shown in FIGS. 2 and 7, said main cord assembly being used to connect and structurally reinforce this embodiment. In a preferred embodiment, said main cord 8 assembly providing a mode of adjusting the tent, whereby after the tent frame is adjusted to a desirable configuration, a user utilizing both hands would grab each of the main cord wraps 3 and pull said main cord wraps 3 downward along the axial direction of arch pole 6, thus adding tension to the main cord 8 and pulling the tip end loop 4 and a tip front loop 5 being connected to the spline pole 7 downward. In a preferred embodiment shown in FIG. 7, symmetry knots 12 being tied into the main cord 8 are movably located adjacent to the arch pole 6 providing a means to synchronize the frame members 6 and 7 in an approximate perpendicular configuration.

A main cord 8 is movably adjusted by a user to configure this embodiment, as shown in FIGS. 1-3, 5, being connected to frame members 6 and 7. To configure this embodiment a user manipulates said main cord 8 downward or upward along the axial direction of said arch pole 6 thus adding or reducing tension on said main cord 8. Tensioning said main cord 8 gives the adjustable frame a dome shape by pulling both ends of the spline pole 7 down and inward over said arch pole 6 providing an open dome shaped frame capable of supporting a fabric cover 10 (FIG. 4) supplying shelter on the rear, left and right sides of the this embodiment. In this embodiment, the spline pole 7 acts as both a ridge frame member supporting the fabric cover 10, the arch pole 6, and also a means of maintaining tension on the main cord 8.

FIG. 4 shows this embodiment with the fabric cover 10 attached. In a preferred embodiment, a lightweight nylon or polyester fabric cover is 10 pulled taut across the frame being fastened to at least one of said frame members, said fabric cover 10 further being fastened to the main cord 3 near the front end of this embodiment and adjustably fastened to the side and rear endpoints of said frame members 6 and 7 providing a substantially enclosed shelter. The collapsible fabric cover as shown in FIG. 4, being connected to the spline pole 7 via multiple cord loops tied into the undersurface of said fabric cover 10 along the ridge where said spline pole 7 is contiguous to said fabric cover 10, further being adjustably fastened to the tip end loop 4 and both ends of the arch pole 6. The fabric cover 10 of FIG. 4, being fastened to portions of the main cord 8 in the frontal portion of this embodiment, wherein said fabric cover 10 is sewn in a way to enable said main cord 8 to pass thru one or more edges thereof thus fastening said fabric cover 10 to said main cord 8.

Adjustably fastened means for connecting vertices of said fabric cover to endpoints of the pole frame assembly include adjustable straps, said adjustable straps including grommets and ladder lock type devices for tightening said fabric cover to the frame assembly.

At least two main cord wraps 3, as shown in FIGS. 1-3, 5, secure this embodiment once the frame assembly is configured. As clearly shown in FIG. 5, the main cord wraps 3 being an aspect of the main cord 8, are comprised of the portion of main cord 8 that circumferentially wraparound said arch pole 6. When the main cord 8 is slackened said main cord wraps 3 loosen allowing movability of said main cord wraps 3 along the axial direction of said arch pole 6. When the main cord 8 is tensioned said main cord wraps 3 tighten around the arch pole 6 gripping the pole with sufficient pressure to hold the main cord wraps 3 in a static position. As shown in FIG. 2, this embodiment is put under tension by pulling the main cord wraps 3 downward to a predetermined point designated by said visual markers 11, or a user determined location, on the arch pole 6.

Visual markers 11 being placed on the arch pole 6, said arch pole 6 being a latitudinal frame member and perpendicularly oriented to said spline pole 7, at predetermined locations thereof providing an aid for adjusting the position of said main cord wraps 3 to a symmetrically configured position. In the embodiment as shown in FIG. 1, visual markers 11 are placed on predetermined locations of the frame assembly to assist a user in quickly and symmetrically tensioning this embodiment, wherein the main cord 8 and frame members 6 and 7 are simultaneously put under tension providing structure and rigidity to the adjustable tent.

Also shown in FIG. 7, said main cord 8 further comprising the symmetry knots 12 or other visual markers placed at predetermined locations on said main cord 8, whereby a user pulls downward on both main cord wraps 3 to a point near said visual markers 11 and further moving said symmetry knots 12 to a point adjacent to the arch pole 7, effectively configuring this embodiment in a symmetrical position. The symmetry knots 12 of FIG. 7, being tied into the main cord 8 at predetermined locations and used to perpendicularly configure frame members 6 and 7, whereby movement of said symmetry knots 12 to a point adjacent to said arch pole 6 thus moves said spline pole 7 to an approximately perpendicular configuration to the said arch pole 6.

An aspect of this embodiment providing an asymmetrically configured tent frame, wherein the frontal portion of said fabric cover 10 being pulled taught by a tensioned main cord 8, said fabric cover 10 being connected to the front tip front loop 5 and adjustably fastened at the rear end of the spline pole 7 and further having at least two vertices capable of being advantageously drawn outward and fastened via guy lines to available terrain or features of the environment.

Additional aspects of this embodiment not defined herein include stabilizing means such as conventional tent stakes and guy lines which act to fasten this embodiment to the surrounding environment. Namely, at least two stakes secure this embodiment to the terrain of which it is being pitched on, said stakes fastening both ends of the ground cord 9 to the ground. Secondary means include guy lines fastened to the bottom edges of the fabric cover and advantageously used to securely fasten said fabric cover 10 directly to the ground. Additional means include guy lines fastened around the arch pole 6 being positioned above the main cord wraps 3 and used to securely fastened the frame assembly to the ground.

Two aspects of this embodiment as shown in FIGS. 1 and 6, including a main cord 8 means and an intersection knot 1 device, each aspect being a movably securable device intended to connect a multi-pole frame assembly and enable adjustability of said assembly. Plastic or metal hardware could be used although these materials are susceptible to breakage due to fatigue, strain or prolonged exposure. In this embodiment cord is used to construct said movably securable devices to include the main cord 8 and intersection knot 1, being that cord is flexible and very durable, can be permanently tied, and can be cinched tight when tensioned further gripping and fastening the pole assembly.

The intersection knot 1 may be made of a tied cord knot or other fastening device. As shown in FIG. 5, the intersection knot 1 is similar to a "Boy Scout Lashing" where a cord or rope is wrapped around a plurality of poles at least two revolutions and fastened when the poles are in a parallel position. In this position, with the poles fastened together at their intersection, rotating said poles to an approximate 90 degree angle further causes said intersection knot 1 to tighten and grip the poles sufficiently enough to securely hold the intersection of the frame members together in one set location, while not crushing the poles due to excessive tightening.

Advantages

From the description above, a number of advantages of some embodiments of my adjustable tent become evident:

a) Construction of the tent requires a minimum number of lightweight parts providing a comparatively ultra-lightweight adjustable tent as compared to other freestanding tents.

b) The adjustable tent is a fully connected system that does not require assembly when put to use; rather, the adjustable tent is simply connected and configured providing a weatherproof shelter.

c) A significant aspect of this embodiment enables the tent frame to be pitched vertically with the ridge being oriented directly over the top of users while on terrain with uneven slope and/or grade.

d) When configured the frame members are connected by a main cord that is tensioned thus holding said frame members under hoop stresses. Hoop stress put on said frame members creates a strengthened frame better configured to resist the pressure and suction of wind loading and the forces of heavy precipitation.

e) Users can adjust the fabric cover to adapt the configuration of this embodiment to available terrain features to provide the optimal amount of weatherproofing coverage.

f) This embodiment being collapsible, lightweight, and made of durable materials can be deployed for extended periods of time; and, being compact when not in use this embodiment is easily transported and stored.

CONCLUSION, RAMIFICATIONS, AND SCOPE

Thus, the reader will see that at least one embodiment of the tent provides a lighter weight, hi-strength and adjustable shelter device with an intrinsically easy set-up, that can be used by persons of any age and pitched upright on uneven or sloping terrain. While my above description provides many specificities, these should not be construed as limitations on the scope, but rather as an exemplification of one embodiment thereof. Many other variations are possible. For example, the fabric cover 10 while being attached to the main cord 8 and frame members 6 and 7 can be stretched outward at one or more vertices to provide added horizontal coverage. The intersection knot 1 could be made of a hub-like device made of plastic or rubber material being used as a movably securable device. Accordingly, the scope should be determined not by the embodiments illustrated, but by the appended claims and their legal equivalents.

I claim:

1. An adjustable tent, comprising:

a. A collapsible pole frame assembly comprised of a plurality of collapsible poles, said poles being interconnected at one or more intersecting points thereof; wherein said poles being comprised of at least two poles having equal or unequal length and thus having at least four pole endpoints are assembled in a way to provide a freestanding tripod base in addition to having one or more said poles cantilevered longitudinally forward of the tripod base;

b. A first movably securable device interconnecting said plurality of poles at one or more intersecting points, said first movably securable device having means of limiting relational rotation of said poles to a predetermined angel, c. A second movably securable device interconnecting said plurality of poles, said device being fastened to the pole endpoints of said frame and movably wrapped circumferentially around at least two pole frame members, wherein manipulating the location of said device thus configures the pole frame assembly providing tension, rigidity, and a dome shape structure to the tent frame; and, d. A collapsible fabric cover with at least four vertices in shape being connected to at least one pole frame member, said cover having adjustable straps to secure said vertices to the base and endpoints of the pole frame assembly, said cover further including integral cord means to fasten said cover to said frame assembly, whereby a user can quickly setup the adjustable frame to stand upright on uneven or sloping terrain and configure said fabric cover by manipulating one or more movably securable devices to provide a substantially enclosed shelter.

2. The adjustable tent of claim 1, wherein said plurality of poles are comprised of a plurality of shorter connectable tube sections being assembled in series providing structural pole frame members to support said tent.

3. The adjustable tent of claim 1, wherein a first movably securable device is comprised of an intersection knot being used as a means of fastening said plurality of poles at their intersecting point, said intersection knot enabling constrained rotation of said plurality of poles whereby the intersection knot tightens as the plurality of poles rotate to a predetermined angle.

4. The intersection knot of claim 3, wherein said intersection knot securely holds the intersecting point of said plurality of poles in a predetermined or user defined location, said intersection knot further including a secondary knot tying a cord means wrapped around the intersection of said plurality of poles in a fashion that restrains relational rotation of said poles such that said poles are not rotated to excess in an undesirable direction.

5. The adjustable tent of claim 1, wherein said poles include an arch-shaped pole frame member perpendicularly intersecting a spline-shaped pole fame member, when erect said pole assembly providing a substantially dome shaped frame having a structural ridge frame member being perpendicularly supported by said spline-shaped pole frame member.

6. The adjustable tent of claim 1, wherein said plurality of poles further including an arch pole framing means of vertically supporting this embodiment structurally, wherein said arch pole is bent with downward force on both ends and held in a predetermined standing arch configuration by means of connecting both downward bent ends of said arch pole together with a cord.

7. The adjustable tent of claim 1, the second movably securable device being comprised of a main cord means that is doubled in nature due to tying both ends of said main cord together whereby the main body of the cord is doubled as represented by a corded loop, wherein said corded loop is held adjacent and parallel in essence as an elongated double corded tied loop, said double corded tied loop is fastened to at least two endpoints of said plurality of poles.

8. The adjustable tent of claim 7, wherein said plurality of poles further includes a spline pole, said spline pole being configured longitudinally over this embodiment's center axis as a ridge frame member, wherein said spline pole intersects said arch pole near the vertices of this embodiment, said spline pole intersecting and being configured above said arch pole and continuing longitudinally forward cantilevered to the front end tip of said spline pole, wherein acting forward longitudinally said spline pole is bowed slightly downward in a spline configuration due to manipulation of said main cord.

9. The adjustment tent of claim 8, wherein the frontal portion of said fabric cover being pulled taught by a tensioned frame assembly via the main cord fastened within said fabric cover, said fabric cover further being connected to the front tip and adjustably fastened at the rear end of the spline pole, said fabric cover further having at least two vertices capable of being advantageously drawn outward and fastened via guy lines to available terrain or features of the environment.

10. The adjustable tent of claim 8, said main cord being fastened to both the front end tip and rear end tip of said spline pole, wherein this embodiment each end of said main cord is fastened to each end of said spline pole, when not tensioned said main cord is configured in parallel near said spline pole being on either side of said spline pole, when tensioned said main cord is pulled in a substantially downward and perpendicular direction and thus applying downward force on each end of said spline pole causing said spline pole to bow in a spline shape.

11. The adjustable tent of claim 10, comprising at least two main cord wraps being a movable element of said main cord, said main cord wraps being the section of said main cord that circumferentially wraps multiple revolutions around one or more of said poles in at least two locations.

12. The adjustable tent of claim 10, further including one cord each wrapped circumferentially around said arch pole at least two revolutions, each of said main cord wraps being on opposite sides of said spline pole as intersected by said arch pole, wherein cord wraps comprise of said main cord perpendicularly wrapping around said arch pole providing a movable fastening point with increased or decreased gripping strength as applied when said main cord wraps are tensioned around said arch pole.

13. The adjustable tent of claim 10, wherein movement of said cord wraps is maintained along said arch poles axial centerline, whereby tensioning said main cord by moving said main cord wraps applies downward force being transferred via said main cord to both the front end tip and rear end tip of said spline pole causing said spline to bow into a spline shape.

* * * * *